US005129322A

United States Patent [19]

Christopher et al.

[11] Patent Number: 5,129,322

[45] Date of Patent: Jul. 14, 1992

[54] EXPLOSIVE TUBING CUTTER AND METHOD OF ASSEMBLY

[75] Inventors: Glenn B. Christopher; Mike Navarette, both of Ft. Worth, Tex.

[73] Assignee: Jet Research Center, Inc., Alvarado, Tex.

[21] Appl. No.: 523,625

[22] Filed: May 14, 1990

[51] Int. Cl.[5] ..... F42B 3/182

[52] U.S. Cl. ..... 102/202.3

[58] Field of Search ..... 102/202.1, 202.2, 202.3; 89/1.15; 166/361

[56] References Cited

U.S. PATENT DOCUMENTS

| | | | |
|---|---|---|---|
| 1,868,224 | 7/1932 | Schurmann | 102/202.3 |
| 1,897,685 | 2/1933 | Williams et al. | 102/202.3 |
| 2,012,827 | 8/1935 | North | 102/202.3 |
| 2,684,030 | 7/1954 | Muskat et al. | 89/1.15 |
| 2,704,032 | 3/1955 | Maruschak et al. | 102/202.3 |
| 2,828,692 | 4/1958 | Webster | 102/202.1 |
| 2,957,415 | 10/1960 | Lazari | 102/202.3 |
| 3,180,262 | 4/1965 | Talley et al. | 102/202.2 |
| 3,182,277 | 5/1965 | Ashby | 102/202.1 |
| 3,332,351 | 7/1967 | Vinson | 102/202.3 |
| 3,638,071 | 1/1972 | Altonen, Jr. et al. | 102/202.3 |
| 4,184,430 | 1/1980 | Mock | 102/307 |

FOREIGN PATENT DOCUMENTS

| | | | |
|---|---|---|---|
| 121555 | 2/1931 | Austria | 102/202.3 |
| 632476 | 12/1961 | Canada | 89/1.15 |

*Primary Examiner*—Deborah L. Kyle
*Assistant Examiner*—Stephen Johnson
*Attorney, Agent, or Firm*—Robert A. Kent

[57] ABSTRACT

A tubing cutter apparatus includes a housing or casing member formed of a zirconia ceramic material. The zirconia ceramic material is located at least proximate an explosive charge section, such the detonation of the explosive charge will cause shattering the ceramic section. The tubing cutter may be assembled in a safe manner by establishing ground connections between separate portions of the apparatus. These ground connections established during assembly will prevent the buildup of static electrical charges, which could cause premature detonation of the cutter.

1 Claim, 3 Drawing Sheets

EXPLOSIVE TUBING CUTTER AND METHOD OF ASSEMBLY

BACKGROUND OF THE INVENTION

The present invention relates generally to an explosive device useful for cutting tubing in oil and gas well drilling applications and a method for assembling the device. More particularly, the device comprises an explosive charge in a zirconia casing, an electrically activated means for detonating the explosive charge, and a housing for attaching the casing and detonation means to a drill string. The explosive charge is then lowered to a desired point in an oil or gas well and detonated by passing an electric charge down the drill string to the detonation means. The method of assembly comprises grounding the explosive charge and detonator at all times during assembly. This minimizes the possibility of detonation during assembly due to static electric charges or stray electric currents in the components of the device. Detonation of the explosive charge or detonation means during assembly could cause serious injury to a person assembling the device.

Conventional devices for cutting tubing in oil or gas wells have used either mechanical cutters or explosive charges to separate the tubing into two segments. Mechanical cutters are lowered into the well to the desired point, and generally include teeth or other cutting elements that rotate or otherwise move and cut through the tubing to separate it. Explosive-charge cutting devices, on the other hand, use a shaped explosive charge that is lowered to the desired point in the well and then detonated. The explosive charge is shaped so that it causes the tubing to separate at the desired point when it is detonated.

Conventional explosive-charge tubing cutters typically enclose the explosive charge in a casing which is attached to a drill string and includes a means for detonating the explosive charge that is activated by an electric current. The electric current is provided by an external circuit and controlled by an operator at the top of the well. The electric current is passed down the drill string by means of a cable to the tubing cutter when the explosive device is at the proper position to cut the tubing. The electric current causes the detonation means, usually a blasting cap, to detonate, which in turn causes the explosive charge to detonate. Ideally, the tubing cutter, except for the explosive charge and its casing, can then be retrieved from the well.

Many conventional explosive-charge tubing cutters use a steel or cast iron casing for the explosive charge. These metal casings have the disadvantage that when the explosive charge is detonated the casing breaks into large pieces. These pieces can then jam or plug parts of the drill string and may make retrieval of the drill string difficult by jamming between the well casing and the drill string.

SUMMARY OF THE INVENTION

The invention comprises an improved tubing cutter device and a method of assembling the device. The device is useful for cutting tubing and casing at a desired place in an oil and gas well during operations. More particularly, the device comprises an explosive charge in a zirconia ceramic casing, a means for detonating the explosive charge, and a housing attachable to a drill string for lowering the charge into a well and for transferring an electric charge that activates the means for detonating the charge. The method of assembly of an explosive device, such as a shaped charge, insures that the conductive elements of the explosive charge are always grounded during assembly so that the possibility of premature detonation is minimized.

The improved tubing cutter device is superior to conventional explosive tubing cutters because zirconia ceramic is tougher than conventional materials used for explosive casings. Further, the zirconia ceramic disintegrates into many fine sand-like particles when the device is detonated, and these particles do not jam or plug other parts of the drill string.

The method of assembly for shaped charges, including the tubing cutter device, can be critical because premature detonation can result in serious injury or death to a person assembling the device. The explosive charge is detonated by means of a small explosive such as a blasting cap which is detonated by an electric charge. During assembly any inadvertent electric charges can detonate the blasting cap or even the explosive charge. Stray electric charges may derive from static electricity or ungrounded circuits. The method of assembly of the invention minimizes this possibility by insuring that the explosive charge and blasting cap are grounded at all times. Conventional methods of assembling explosive tubing cutters do not necessarily provide a ground for the explosive charge and blasting cap at all times.

DETAILED DESCRIPTION OF THE INVENTION

Figure 1:
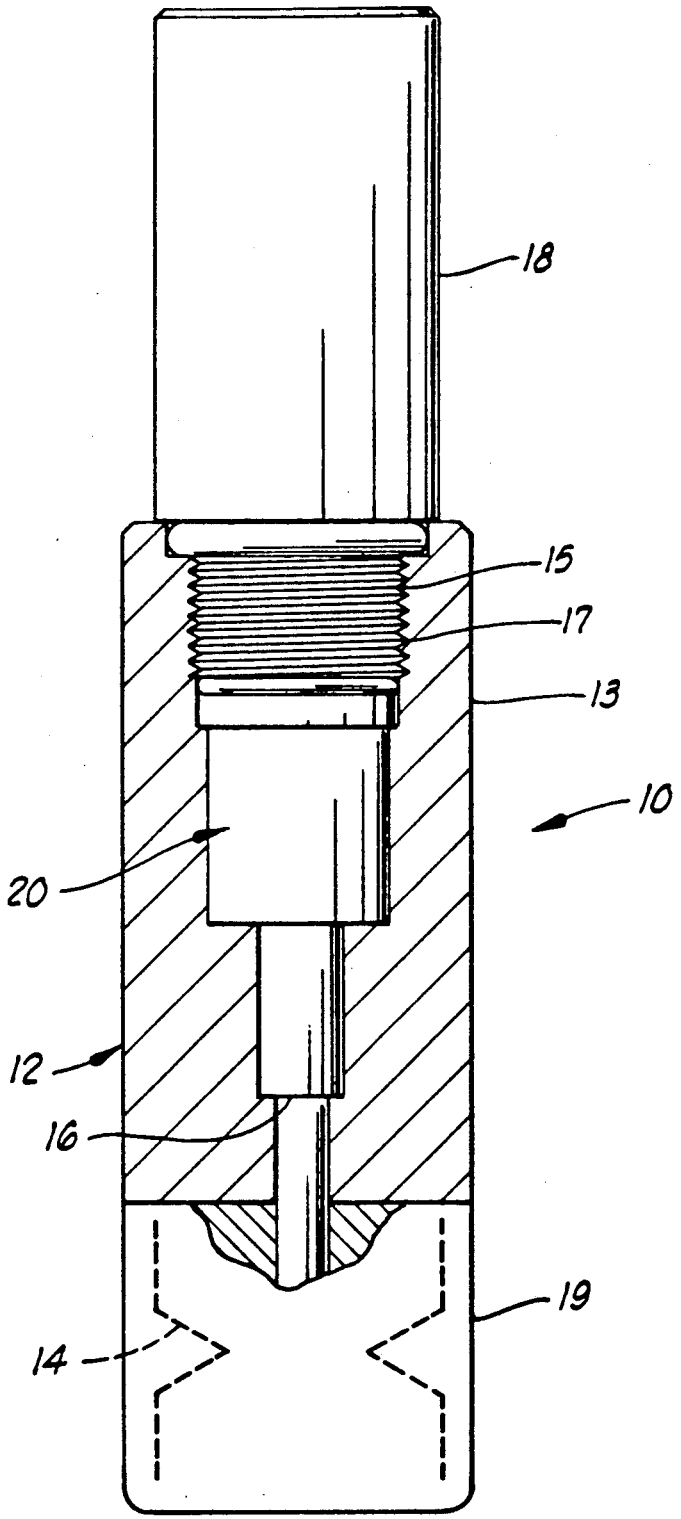
FIG. 1 depicts a cross-sectional view of the assembled tubing cutter, detonator, and firing head.

The present invention includes a novel explosive device for cutting tubing in oil well drilling operations and a method of assembling an explosive device. Referring to FIG. 1, a schematic view of a tubing cutter assembly 10 in accordance with the present invention is depicted, partially in a vertical section. The assembly includes a tubing cutter 12 which is comprised of an explosive charge 14, a blasting cap 16, a firing head 18, and a detonator assembly 20.

Tubing cutter 12 comprises an upper housing 13 which is preferably made of steel and includes a threaded female aperture 15. The threaded female aperture 15 of upper housing 13 is screwed onto a threaded male end 17 of the firing head 18. The interior of the upper housing 13 is open and adapted to receive firing head 18, including detonator assembly 20. The bottom housing 19 of tubing cutter 12 is made from zirconia ceramic and includes a generally toroidal shaped charge 14. Shaped charge 14 will cut the tubing when the charge is detonated. Bottom housing 19 of tubing cutter 12 may be attached to the upper part of the tubing cutter in a conventional manner, such as through use of a suitable adhesive.

Zirconia ($ZrO_2$) ceramic has low thermal conductivity, chemical inertness to molten metals, and a modulus of elasticity comparable to steel. Table 1 includes various properties for zirconia.

TABLE 1

| | |
|---|---|
| Mechanical Properties: | |
| Density (g/cm$^3$) | 5.58 |
| Vickers Hardness Hv (kg/mm$^2$) | 1,500 |
| Bending Strength (psi) | 55,000 |
| Compressive Strength (psi) | 285,000 |
| Youngs Modulus ($\times 10^6$ psi) | 27 |
| Poissons Ratio | 0.30 |
| Fracture Toughness (MN/m$^{1.5}$) | 7.0 |
| Thermal Properties: | |
| Thermal Conductivity, cal cm/cm$^2$s deg C | 0.084 |
| Specific Heat, cal/g at 25° C. | 0.066 |
| Maximum Service Temperature, °F. | 350 |
| Surface Quality: | |
| As Sintered (RMS micro inches) | 15–25 |
| Ground (RMS micro inches) | 20–40 |
| Polished (RMS micro inches) | 2–10 |

Zirconia ceramic is preferred over steel or similar metals for the casing of the explosive charge because when the charge is detonated, the zirconia disintegrates into many fine sand-like particles. In contrast, a steel or cast iron casing does not disintegrate but instead forms large pieces when the explosive charge is detonated. It should be appreciated that these pieces of steel can damage other equipment in the oil or gas well and can also jam parts of the drill string.

Zirconia ceramic is preferred over conventional ceramic casings for the explosive charge because it is less prone to breakage than other ceramics for downhole operations. In particular, other ceramics which have been used for items such as tubing cutter charge housings, such as alumina ceramics, are relatively brittle and prone to breaking or cracking when being lowered into a well. For example, the fracture toughness for zirconia ceramic is 7.0 as shown in Table 1 while the comparable fracture toughness for alumina ceramics ranges from 3.2 to 4.1. The zirconia is believed to be approximately twice as resistant to fractures than the alumina ceramic. A zirconia ceramic material which has been found satisfactory for use for explosive charge casings is manufactured by Kyocera Feldmuehle, Inc., a corporation doing business at 100 Industrial Park Road, P. 0. Box 678, Mountain Home, N.C. 28758.

Figure 2:
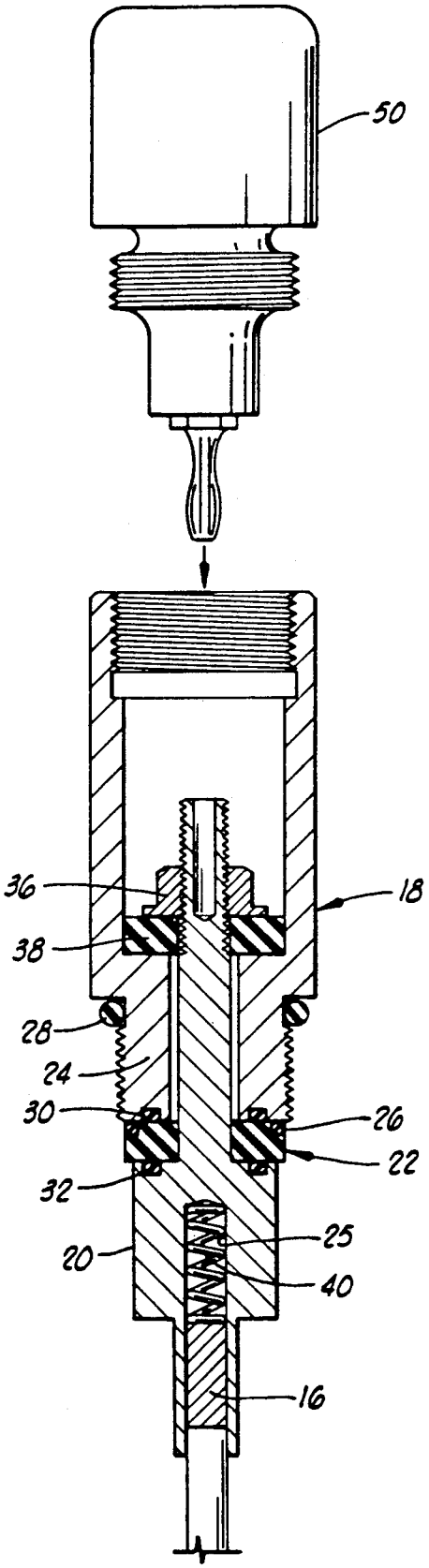
FIG. 2 depicts a detailed cross-sectional view of the firing head and detonator assembled together.

Referring to FIG. 2, therein is depicted, partially in vertical section, along with an exemplary thread protector/shorting plug for use in practicing a method of assembly in accordance with the present invention, a schematic view of the assembled firing head 18 and detonator 20. The firing head assembly 18 comprises a firing head housing 24; detonator assembly 20; a washer 22; o-rings 26, 28, 30, and 32; a nut and bolt 36; a washer 38, and a spring 40.

The firing head housing 24 includes a larger diameter end with a female threaded fitting, and a smaller diameter end with a male threaded fitting. The female threaded end will facilitate the securing of other components to the firing head, and the male threaded end will facilitate the coupling of the firing head to a tubing cutter such as depicted in FIG. 1. Firing head 18 is fitted with o-ring 26 which provides a seal between the firing head 18 and the tubing cutter 12 when the firing head/-detonator assembly is threaded into the tubing cutter.

The detonator assembly 20 is coupled to firing head housing 24 such as through use of a threaded end and a nut 36. Detonator assembly 20 includes a spring 40 which is fitted into the recess 25 in the detonator where a blasting cap detonative charge 16 fits. The spring is electrically conductive. It should be appreciated that the spring and detonator form part of the firing circuit that transfers an electric charge to the detonation means or blasting cap. Specifically, detonator assembly 20 conducts electricity from the end that is inserted into the firing head to blasting cap 16.

Figure 3:
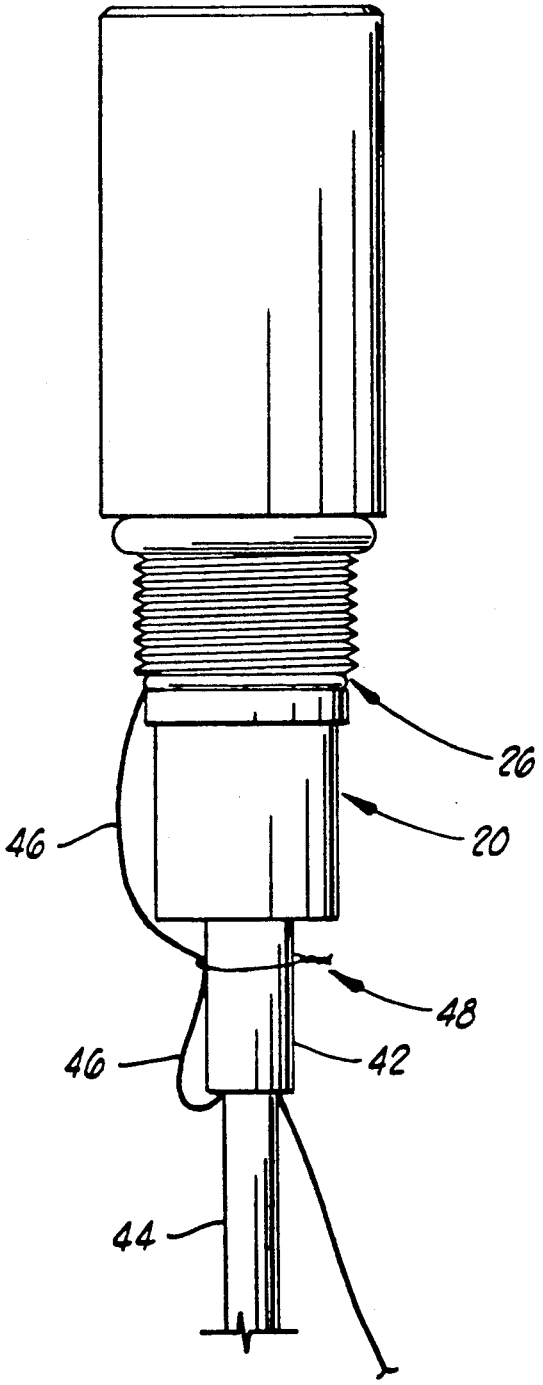
FIG. 3 depicts a schematic view of the bottom of the detonator including a blasting cap, a grounding wire, and a temporary grounding wire.

The firing head is assembled by attaching the detonator assembly 20 to firing head housing 24. The assembly method of the present invention includes the establishing of a grounding electrical connection between the detonator and the firing head housing at the time of assembly. In the depicted embodiment, this is accomplished by placing a shorting plug 50 in firing head housing 24, such that it will electrically engage detonator assembly 20 and form a circuit between detonator assembly 20 and firing head housing 24 at the time detonator assembly 20 is coupled to housing 10. At the time of assembly, a temporary ground wire 46, as depicted in FIG. 3, will preferably be used to establish an electrical connection between spring 40 and the remainder of detonator assembly 20. The temporary electrical connection is maintained by any suitable temporary connector or tie, such as a twisted wire tie 48, which secures ground wire 46 to assembly 20. When the detonator assembly is secured to firing head housing 24, the upper end of this temporary grounding wire 46 may be placed in electrical contact with firing head housing 24, thereby establishing electrical continuity between all parts. When it is desired to run the tubing cutter, this temporary ground wire may be removed.

Thus, the assembly method of the present invention assures that an electrical connection is maintained between the firing head housing and the detonator during assembly, and therefore assures that static charges which could potentially actuate the detonator will not be established between the two components.

Many modifications and variations may be made in the techniques and structures described and illustrated herein without departing from the spirit and scope of the present invention. Accordingly, it should be readily understood that the embodiments described and illustrated herein are illustrative only and are not to be considered as limitations upon the present invention.

What is claimed is:

1. A method of assembling a tubing cutting apparatus comprising an upper housing including a firing head and a detonator assembly and a lower housing including a shaped charge explosive comprising the steps of:

establishing a first removable electrical connection between a conductive element in said detonator assembly and an electrical ground;

connecting said firing head to another removable electrical connection whereby said firing head may be conductively connected to said detonator assembly at a time proximate connection of said firing head to said detonator assembly;

connecting said firing head to said detonator assembly to form said upper housing whereby said firing head is conductively connected to said conductive element in said detonator assembly and grounded thereby;

establishing a removable electrical connection between said firing head and said first removable electrical connection;

removing said another electrical connection and connecting said assembled firing head and detonator to a mean for subsequently introducing an electrical charge through said firing head and into said detonator assembly; and removing said first removable electrical connection from contact with said upper housing and connecting said upper housing to said lower housing whereby said detonator assembly may be activated by an electrical charge to initiate said shaped charge explosive.

* * * * *